US011189899B2

(12) United States Patent
Takahashi

(10) Patent No.: US 11,189,899 B2
(45) Date of Patent: Nov. 30, 2021

(54) FEED CIRCUIT, ANTENNA, AND METHOD FOR CONFIGURING ANTENNA

(71) Applicant: NEC CORPORATION, Tokyo (JP)

(72) Inventor: Yoshihide Takahashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 44 days.

(21) Appl. No.: 16/628,471

(22) PCT Filed: Jun. 1, 2018

(86) PCT No.: PCT/JP2018/021123
§ 371 (c)(1),
(2) Date: Jan. 3, 2020

(87) PCT Pub. No.: WO2019/008963
PCT Pub. Date: Jan. 10, 2019

(65) Prior Publication Data

US 2020/0127360 A1 Apr. 23, 2020

(30) Foreign Application Priority Data

Jul. 7, 2017 (JP) ..... JP2017-133541

(51) Int. Cl.

| | |
|---|---|
| ***H01P 3/18*** | (2006.01) |
| ***H01Q 21/06*** | (2006.01) |
| ***H01P 5/04*** | (2006.01) |
| ***H01Q 13/10*** | (2006.01) |
| ***H01Q 21/00*** | (2006.01) |
| ***H01P 11/00*** | (2006.01) |
| ***H01P 5/12*** | (2006.01) |

(52) U.S. Cl.
CPC ..... *H01P 3/18* (2013.01); *H01P 5/04* (2013.01); *H01P 5/12* (2013.01); *H01P 11/002* (2013.01); *H01Q 13/10* (2013.01); *H01Q 21/0043* (2013.01); *H01Q 21/064* (2013.01)

(58) Field of Classification Search
CPC .. H01P 3/18; H01P 5/04; H01P 11/002; H01P 3/12; H01P 5/12; H01Q 13/10; H01Q 21/0043; H01Q 21/0087; H01Q 21/064
USPC ..... 333/1, 100, 236, 239, 245
See application file for complete search history.

(56) References Cited

FOREIGN PATENT DOCUMENTS

| | | | |
|---|---|---|---|
| JP | 59-132204 | A | 7/1984 |
| JP | 2006-33697 | A | 2/2006 |

(Continued)

OTHER PUBLICATIONS

Machine English Translation of JP2006-33697 Published on Feb. 2, 2006 (Year: 2006).*

(Continued)

*Primary Examiner* — Rakesh B Patel
*Assistant Examiner* — Jorge L Salazar, Jr.
(74) *Attorney, Agent, or Firm* — Sughrue Mion, PLLC

(57) ABSTRACT

The present invention provides a feed circuit capable of enhancing a mechanical strength and electrical characteristics thereof. A waveguide is provided on a plate-like member, and has a plurality of branches. A bridging part-extends in a Y direction intersecting an X direction in which the waveguide-guides an electromagnetic wave between sidewalls of the waveguide (14), and includes a plurality of members provided at predetermined intervals in the X direction so that intensity of a reflected wave becomes a predetermined intensity or less.

9 Claims, 14 Drawing Sheets

(56) References Cited

FOREIGN PATENT DOCUMENTS

| | | | |
|---|---|---|---|
| JP | 2010-178305 | A | 8/2010 |
| JP | 2013-141125 | A | 7/2013 |
| JP | 2014-170989 | A | 9/2014 |
| JP | 2017-60086 | A | 3/2017 |

OTHER PUBLICATIONS

Machine English Translation of JP2014170989 Published on Sep. 18, 2014 (Year: 2014).*
International Search Report of PCT/JP2018/021123 dated Jul. 24, 2018 [PCT/ISA/210].

* cited by examiner

FEED CIRCUIT, ANTENNA, AND METHOD FOR CONFIGURING ANTENNA

CROSS REFERENCE TO RELATED APPLICATIONS

This application is a National Stage of International Application No. PCT/JP2018/021123, filed Jun. 1, 2018, claiming priority to Japanese Patent Application No. 2017-133541 filed Jul. 7, 2017, the contents of all of which are incorporated herein by reference in their entirety.

TECHNICAL FIELD

The present invention relates to a feed circuit, an antenna, and a method for configuring an antenna.

BACKGROUND ART

In a communication apparatus used in an outdoor base station for radio communication, a planar antenna provided with an array antenna is used in response to a demand for a thinner and smaller antenna. In particular, in a high-frequency region, for example, in a millimeter-wave band, a waveguide slot array antenna that includes a low-loss feed circuit composed of a waveguide circuit is used. As an example of such an antenna, a slot array antenna is disclosed (Patent Literature 1) in which electromagnetic waves are radiated from a plurality of radiation slots by guiding them with a waveguide having a plurality of branches.

Further, a center-feed waveguide type planar slot antenna that reduces reflected waves by providing a reflection preventing wall at a branched part of a waveguide of a feed circuit is disclosed (Patent Literature 2).

CITATION LIST

Patent Literature

Patent Literature 1: Japanese Unexamined Patent Application Publication No. 2014-170989
Patent Literature 2: Japanese Unexamined Patent Application Publication No. 2006-33697

SUMMARY OF INVENTION

Technical Problem

In the above-described feed circuit used for the antenna, it is necessary to make the width of the waveguide formed in the feed circuit constant in order for the phases of the electromagnetic waves radiated from respective radiation slots to be uniform. This is because when the width of the waveguide formed in the feed circuit varies, the phases of the electromagnetic waves radiated from respective radiation slots become nonuniform, and the gain degradation and the side-lobe level increase.

FIG. 15 is a perspective view showing a configuration of a common feed circuit 40. The feed circuit 40 includes a waveguide 44 having a plurality of branches formed in a conductive plate-like member 43. An electromagnetic wave received from an introduction end 45 is guided from a terminal part 46 to the upper radiation slot via branches. As the waveguide formed in the feed circuit 40 has a plurality of branches, a part of the plate-like member 43 becomes thinner. For example, when a force F is applied, during assembly of the feeder circuit 40 and assembly of the antenna, to such a part of the plate-like member 43 that becomes thinner, the part is deformed, thereby causing a variation (a reference sign 51) of the width of the waveguide and cracking (a reference sign 52) of the plate-like member 43. Note that FIG. 15 shows the contour of the plate-like member 43 that is not deformed by a broken line.

In a millimeter wave band, as the width of the waveguide of the feed circuit is about several millimeters, the structure of the feed circuit is fine. Thus, the width of the waveguide is likely to vary due to distortion or breakage of the waveguide pattern. In the case of the millimeter wave band, the allowable variation of the width of the waveguide is smaller than ±10% of the width of the waveguide, and in particular, a strict dimensional accuracy is required.

Meanwhile, in the aforementioned slot array antenna, by forming different waveguide patterns in a plurality of layers and stacking these layers to form one feed circuit, a mechanical strength of the feed circuit is enhanced. However, this structure increases the thickness of the antenna, causing a cost increase due to an increase in material costs and the number of manufacturing processes.

The present invention has been made in view of the aforementioned circumstances and an object thereof is to provide a feed circuit capable of enhancing a mechanical strength and electrical characteristics thereof.

Solution to Problem

A feed circuit according to one aspect of the present invention includes: a waveguide having a plurality of branches, the waveguide being provided on a plate-like member; and a bridging part that is located between sidewalls of the waveguide and extends in a direction intersecting a direction in which the waveguide guides an electromagnetic wave, and that includes a plurality of members provided at predetermined intervals in the direction in which the waveguide guides an electromagnetic wave so that intensity of a reflected wave becomes a predetermined intensity or less.

An antenna according to one aspect of the present invention includes: a bottom plate provided with a feed slot; a feed circuit including: a waveguide having a plurality of branches that is coupled to the feed slot at one place; and a bridging part that is located between sidewalls of the waveguide and extends in a direction intersecting a direction in which the waveguide guides an electromagnetic wave, and that includes a plurality of members provided at predetermined intervals in the direction in which the waveguide guides an electromagnetic wave so that intensity of a reflected wave becomes a predetermined intensity or less; a coupling layer provided with a plurality of coupling slots that are coupled to a plurality of ends of the waveguide; a cavity layer provided with a plurality of cavities that are coupled to the plurality of coupling slots; and a radiation slot layer provided with a plurality of radiation slots that are coupled to a plurality of cavities and are each configured to radiate an electromagnetic wave.

A method for configuring a feed circuit according to one aspect of the present invention includes forming a bridging part so that it is located between sidewalls of a waveguide, which has a plurality of branches and is provided on a plate-like member, and extends in a direction intersecting a direction in which the waveguide guides an electromagnetic wave, the bridging part comprising a plurality of members provided at predetermined intervals in the direction in which the waveguide guides an electromagnetic wave so that intensity of a reflected wave becomes a predetermined intensity or less.

Advantageous Effects of Invention

According to the present invention, it is possible to provide a feed circuit capable of enhancing a mechanical strength and electrical characteristics thereof.

DESCRIPTION OF EMBODIMENTS

Example embodiments of the present invention are described hereinafter with reference to the drawings. Throughout the drawings, the same elements are denoted by the same reference symbols and duplicated descriptions will be omitted as necessary for the sake of clarification of the description.

First Example Embodiment

Figure 1:
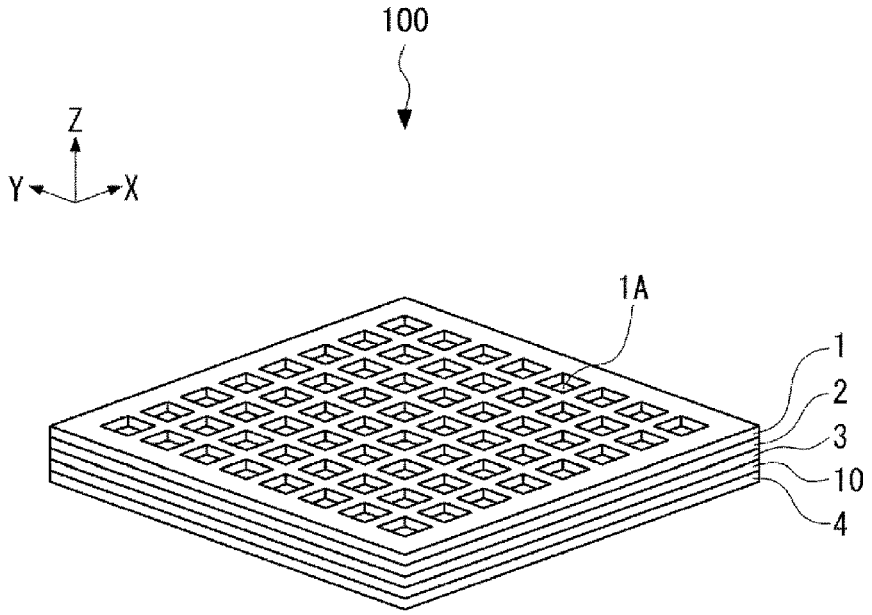
FIG. 1 is a perspective view of an antenna according to a first example embodiment when viewed from the upper surface side thereof.
Figure 2:
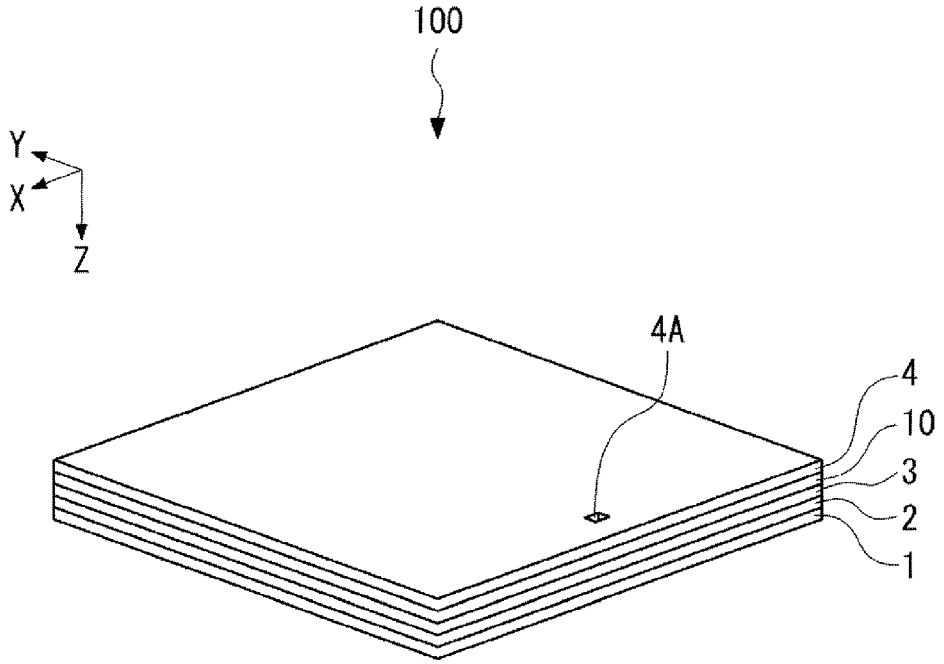
FIG. 2 is a perspective view of the antenna according to the first example embodiment when viewed from the bottom surface side thereof.

An antenna 100 according to a first example embodiment is described below. The antenna 100 is configured as a multilayer planar antenna. FIG. 1 is a perspective view of the antenna 100 according to the first example embodiment when viewed from the upper surface side thereof. FIG. 2 is a perspective view of the antenna 100 according to the first example embodiment when viewed from the bottom surface side thereof.

As shown in FIG. 1, radiation slots 1A constituting an antenna element are arranged in a matrix on the upper surface of the antenna 100. As shown in FIG. 2, a feed slot 4A is provided on the bottom surface of the antenna 100. In the antenna 100, by feeding electric power from an external power feeding source through the feed slot 4A, it is possible to radiate radio waves from each of the radiation slots 1A, and to output the radio waves received through the radiation slots 1A to the outside of the antenna 100.

Figure 3:
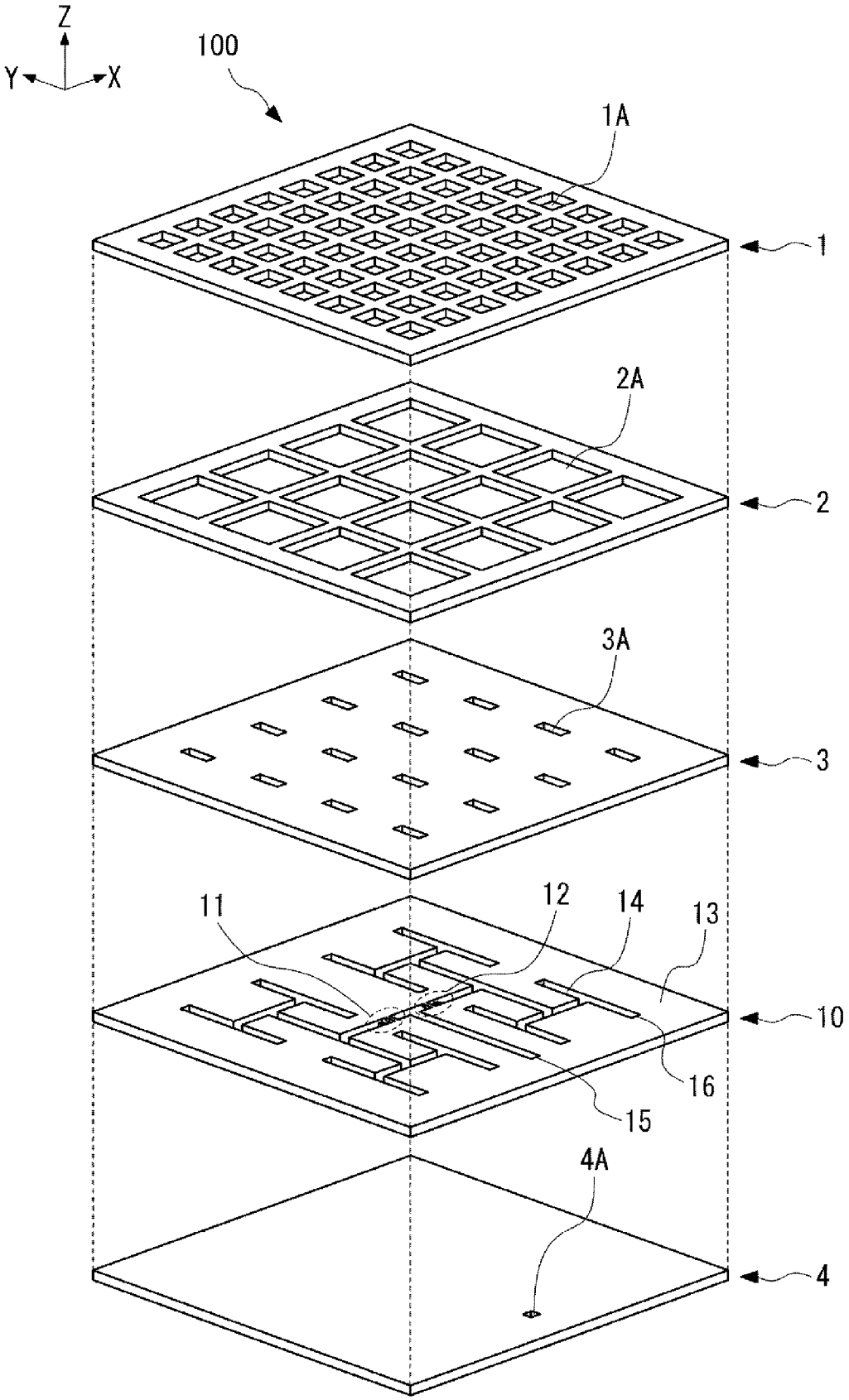
FIG. 3 is an exploded perspective view of the antenna according to the first example embodiment when viewed from the upper surface side thereof.

FIG. 3 is an exploded perspective view of the antenna 100 according to the first example embodiment when viewed from the upper surface side thereof. As shown in FIG. 3, a radiation slot layer 1, a cavity layer 2, a coupling layer 3, a feed circuit 10, and a bottom plate 4 are stacked, thereby constituting the antenna 100. It should be noted that the direction in which the radiation slot layer 1, the cavity layer 2, the coupling layer 3, the feed circuit 10, and the bottom plate 4 are stacked is defined as the Z direction, and the principal surfaces of the radiation slot layer 1, the cavity layer 2, the coupling layer 3, the feed circuit 10, and the bottom plate 4 are defined as the X-Y plane.

The radiation slot layer 1 is a conductive plate-like member, and is stacked on the cavity layer 2. On the radiation slot layer 1, the radiation slots 1A, each of which is an opening capable of radiating radio waves in a space, are provided in a matrix. In this example, 64 (8×8=64) radiation slots 1A are formed in the radiation slot layer 1.

The cavity layer 2 is a conductive plate-like member, and is stacked on the coupling layer 3. A plurality of openings are provided in a matrix in the cavity layer 2 as cavities 2A that simultaneously excite a plurality of radiation slots 1A. In this example, four (2×2=4) radiation slots 1A are coupled to one cavity 2A. That is, the cavity layer 2 is provided with 16 (4×4=16) cavities 2A. The cavities 2A are each configured so as to excite electromagnetic waves therein. The shape of the cavity 2A and the thickness of the cavity layer 2 are determined in accordance with the band of radiated electromagnetic waves and the like.

The coupling layer 3 is a conductive plate-like member, and is stacked on the feed circuit 10. In the coupling layer 3, a plurality of coupling slots 3A, which are openings that radiate electromagnetic waves to the respective cavities 2A, are provided in a matrix. One end of each of the coupling slots 3A is coupled to one end of the corresponding cavity 2A without a gap therebetween. By this configuration, the coupling slots 3A radiate the electromagnetic waves guided to terminal parts 16 of the feed circuit 10 into the cavities 2A. The same number of coupling slots 3A as that of cavities 2A are provided. That is, in this example, 16 (4×4=16) coupling slots 3A are provided.

The configuration of the feed circuit 10 is described below in detail. The feed circuit 10 is a conductive plate-like member, and is stacked on the bottom plate 4. A waveguide 14 having a plurality of branches is provided so that the distances from an introduction end 15 provided on the feed slot 4A of the bottom plate 4 to each terminal part 16, to which the coupling slot 3A of the coupling layer 3 is coupled, are equal. By this configuration, it is possible to guide the electromagnetic waves received from the feed slot 4A to each of the terminal parts 16 in phase with each other.

Figure 4:
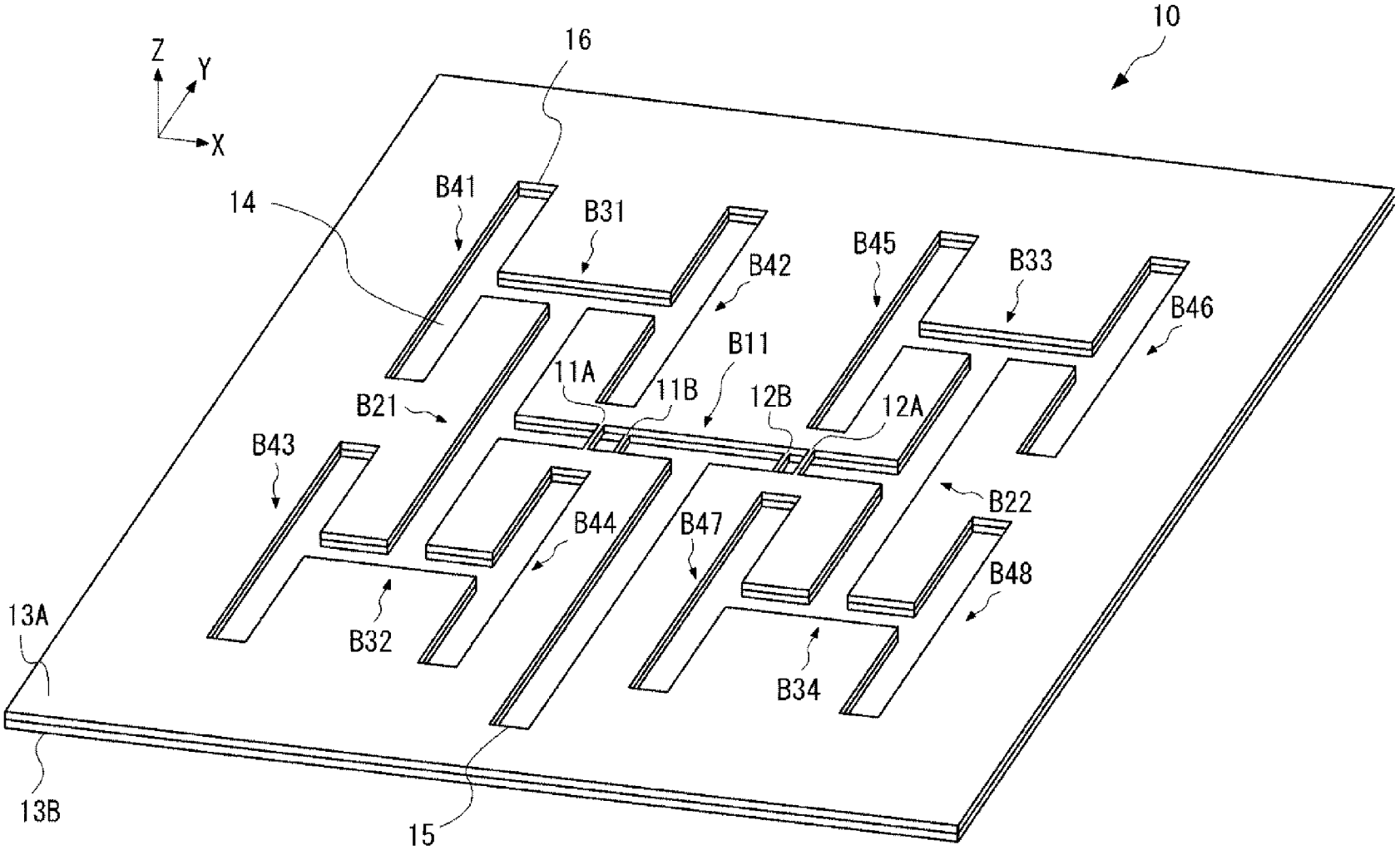
FIG. 4 is a perspective view of a feed circuit according to the first example embodiment when viewed from the upper surface side thereof.
Figure 5:
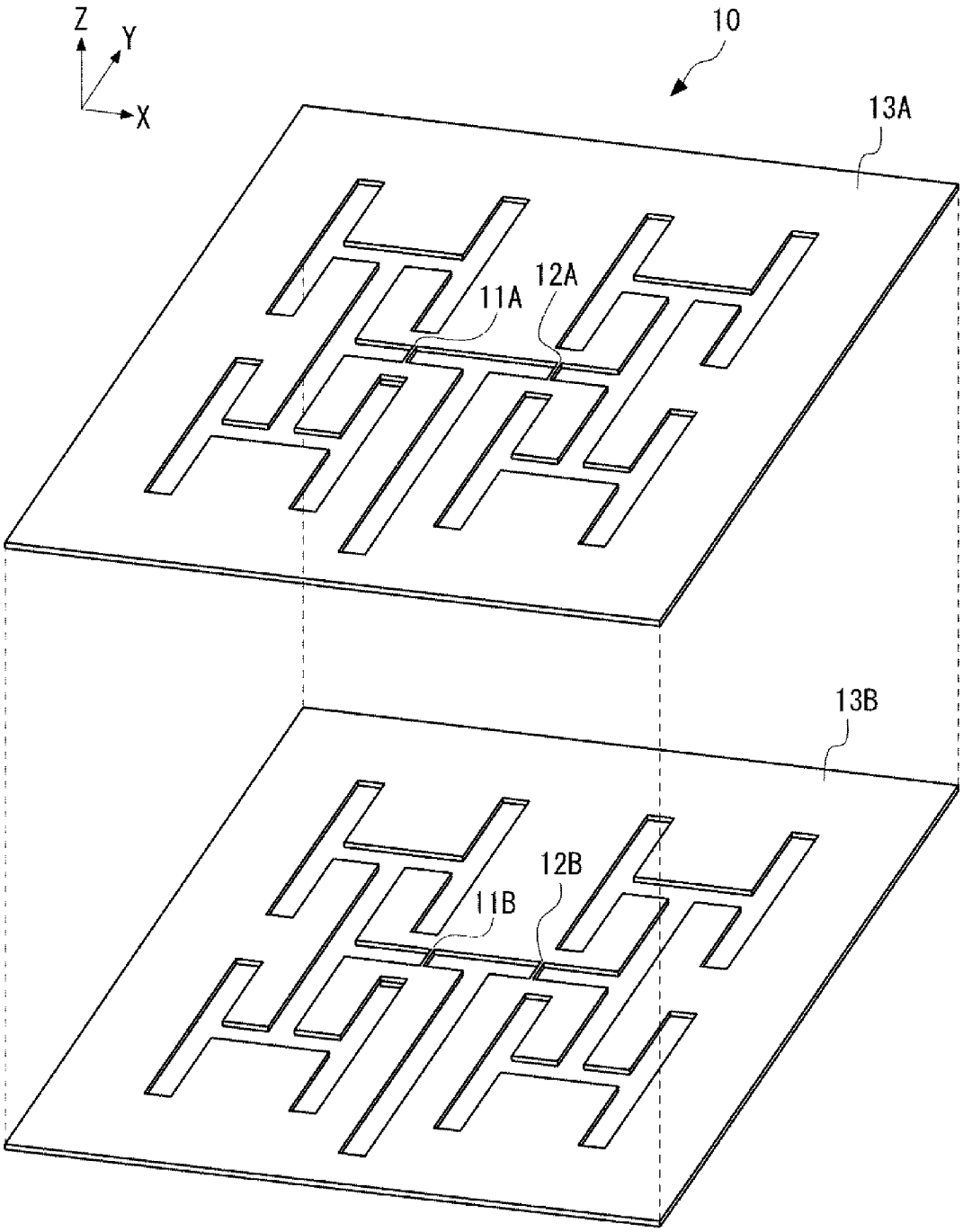
FIG. 5 is an exploded perspective view of the feed circuit according to the first example embodiment when viewed from the upper surface side thereof.

The feed circuit 10 is described in detail. FIG. 4 is a perspective view of the feed circuit 10 according to the first example embodiment when viewed from the upper surface side thereof. FIG. 5 is an exploded perspective view of the feed circuit 10 according to the first example embodiment when viewed from the upper surface side thereof. The feed circuit 10 is provided with the waveguide 14 having a plurality of branches in a conductive plate-like member 13. In this example, the waveguide 14 extends in the Y direction from the introduction end 15 coupled to the feed slot 4A. The waveguide 14 is branched at a branch position B11 at an angle of 90° in the X direction. Next, it is further branched at branch positions B21 and B22 at an angle of 90° in the Y direction. Next, it is further branched at branch positions B31 to B34 at an angle of 90° in the X direction. Next, it is further branched at branch positions B41 to B48 at an angle of 90° in the Y direction. The terminal parts of the waveguide extending in the Y direction from the branch positions B41 to B48 correspond to the terminal parts 16 described above.

The feed circuit 10 can be produced, for example, by forming an etching mask on a conductive plate-like member and then performing etching to remove a predetermined part of the conductive plate-like member.

The feed circuit 10 guides, for example, an electromagnetic wave in the millimeter wave band. However, when such an electromagnetic wave having a short wavelength is guided, it is necessary to reduce variations in the width of the waveguide 14. Therefore, bridging parts that mechanically couple the side surfaces of the waveguide 14 to each other are provided in the feed circuit 10. As shown in FIG. 4, the bridging parts are provided at positions after the branch position B11 where the waveguide 14 extending from the introduction end 15 is first branched. That is, in FIG. 4, a bridging part 11 is provided between the branch positions B11 and B21, and a bridging part 12 is provided between the branch positions B11 and B22.

Each of the bridging parts is composed of a plurality of members, each of which is located between two side surfaces of the waveguide 14 and extends in a direction intersecting the direction in which the waveguide extends. An example in which the bridging parts 11 and 12 are composed of two members is described below.

Figure 6:
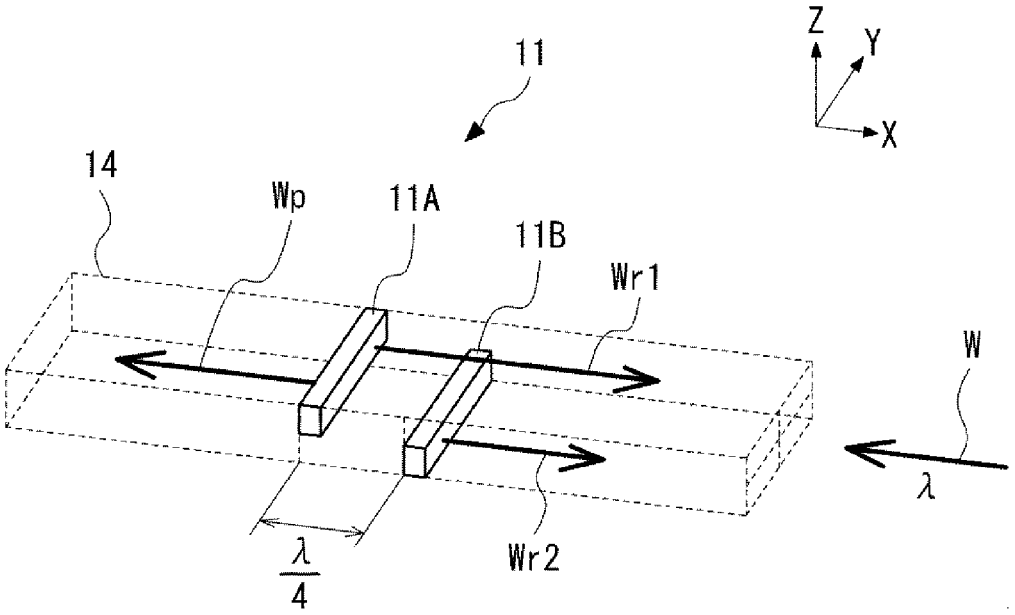
FIG. 6 is an enlarged perspective view of a bridging part according to the first example embodiment.

FIG. 6 is an enlarged perspective view of the bridging part 11 according to the first example embodiment. In FIG. 6, to make understanding of the structure of the bridging part 11 easier, members other than the bridging part 11 are omitted, and the waveguide 14 is indicated by a broken line. The bridging part 11 is composed of members 11A and 11B, each of which is located between two side surfaces of the waveguide 14 extending in the X direction and extends in the Y direction. It should be noted that the direction in which the waveguide 14 extends, that is, the direction in which an electromagnetic wave is guided is defined as the X direction, and the longitudinal direction of the members 11A and 11B, that is, the direction perpendicular to the side surfaces of the waveguide 14, is defined as the Y direction. It is desired that the length of each of the members 11A and 11B in the Y direction be equal to the design value of the width of the waveguide 14 in the Y direction. In this case, both ends of each of the members 11A and 11B are bonded to the respective opposing side surfaces of the waveguide 14 without a gap therebetween. By this configuration, it is possible to prevent the width of the waveguide 14 from being narrower than the design value due to a deformation of the feed circuit 10.

In this example embodiment, a first feed circuit layer 13A and a second feed circuit layer 13B are stacked, thereby constituting the feed circuit 10. A pattern of the waveguide 14 formed in the first feed circuit layer 13A is similar to that formed in the second feed circuit layers 13B. However, the member 11A is formed on the first feed circuit layer 13A, and the member 11B is formed on the second feed circuit layer 13B. That is, the members 11A and 11B are arranged at different positions in the direction (i.e., the Z direction) perpendicular to the direction in which an electromagnetic wave travels and the longitudinal direction of the members 11A and 11B. Note that in a case where the propagation characteristics of electromagnetic waves propagating through the waveguide 14 are taken into consideration, it is desired that the members 11A and 11B be arranged so as not to overlap each other when viewed from the direction (X direction) in which the electromagnetic wave travels as in the configuration of this example embodiment.

In this case, it is possible to integrally form the waveguide 14 and the member 11A of the first feed circuit layer 13A, and to integrally form the waveguide 14 and the member 11B of the second feed circuit layer 13B. Accordingly, the members 11A and 11B are physically, continuously formed on the side surfaces of the waveguide 14, and are formed of integrated materials. Therefore, even if such a force that the width of the waveguide 14 is increased acts on the feed circuit 10, the distance between the two side surfaces of the waveguide 14 can be kept by the members 11A and 11B, thereby preventing variations in the width of the waveguide 14.

In the configuration of this example embodiment, as the members 11A and 11B are inserted into the waveguide 14, a reflected wave is generated with respect to the electromagnetic wave passing through the bridging part. Thus, the members 11A and 11B are formed so as to be separated from each other by a predetermined distance in the X direction in which the waveguide 14 extends, so that they reduce the reflected waves. Specifically, the members 11A and 11B are arranged so as to be separated from each other by ¼ of a wavelength $\lambda(\lambda/4)$ of the electromagnetic wave propagating through the waveguide 14 in the X direction in which the waveguide 14 extends. It should be noted that the wavelength $\lambda$ of the electromagnetic wave is, for example, one of the wavelength of the electromagnetic wave to be transmitted to and received from the antenna 100 and the wavelength included in the band of the electromagnetic wave.

When an electromagnetic wave W reaches the bridging part 11, a reflected wave Wr1 due to the member 11A and a reflected wave Wr2 due to the member 11B, which are propagated in the direction opposite to that of the electromagnetic wave W, are generated in addition to an electromagnetic wave Wp passing through the bridging part 11. However, as described above, the members 11A and 11B are located so as to be separated from each other by $\lambda/4$ in the X direction. Thus, the phase of the reflected wave Wr1 reaching the member 11B is opposite to the phase of the reflected wave Wr2 reflected by the member 11B. As a result, the reflected waves Wr1 and Wr2 cancel each other, whereby it is possible to prevent the reflected waves returning to the introduction end 15 or reduce the number of the reflected waves returning thereto.

Note that although the interval between the members is $\lambda/4$, it may be an odd multiple of $\lambda/4$ in order to cancel the reflected waves.

Further, it is desired that the dimension of each of the members 11A and 11B in the X direction be less than $\lambda/4$ as the interval between the members is $\lambda/4$.

Next, the bridging part 12 is described. Members 12A and 12B of the bridging part 12 correspond to the members 11A and 11B of the bridging part 11, respectively. As compared to the members 11A and 11B, the positions of the members 12A and 12B are exchanged places with each other in the X direction. However, the member 12B is disposed at a position close to the branch position B11 and the member 12A is disposed at a position distant from the branch position B11 so that it can be understood that the configuration of the bridging part 12 is the same as that of the bridging part 11.

Accordingly, in the bridging part 12 also, the phase of the reflected wave Wr1 reaching the member 12B is opposite to that of the reflected wave Wr2 reflected by the member 12B. As a result, the reflected waves Wr1 and Wr2 cancel each other, whereby it is possible to prevent the reflected waves returning to the introduction end 15 or reduce the number of the reflected waves returning thereto.

Figure 7:
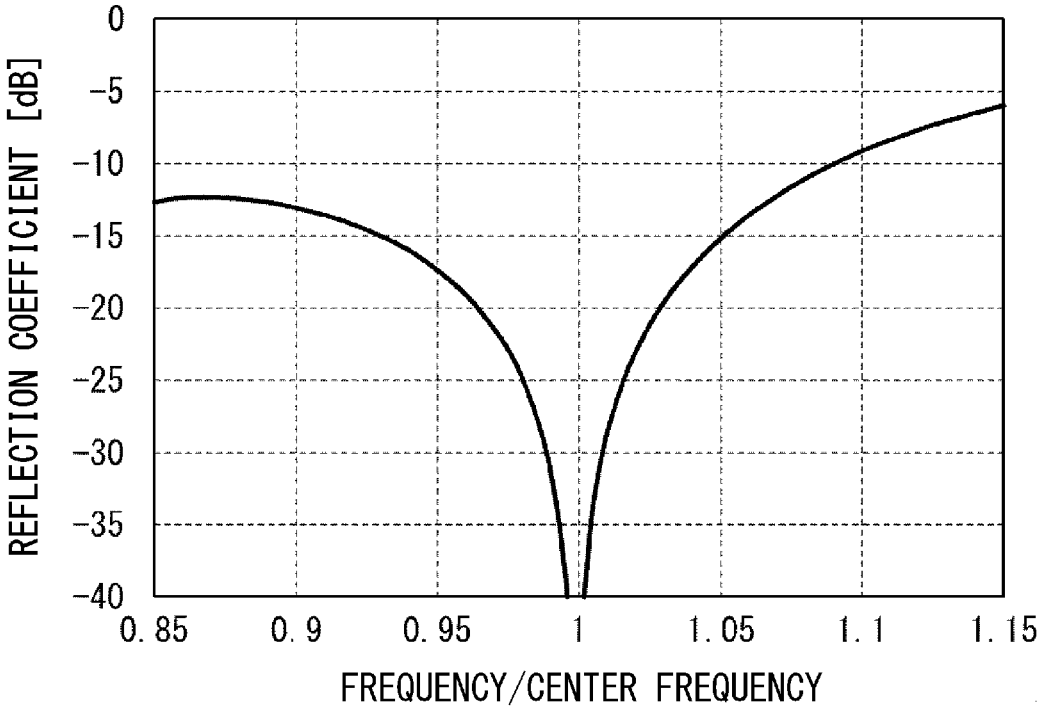
FIG. 7 is a graph showing frequency characteristics of a reflected wave at an introduction end of the feed circuit according to the first example embodiment.

FIG. 7 is a graph showing frequency characteristics of a reflected wave at the introduction end 15 of the feed circuit 10 according to the first example embodiment. In FIG. 7, the horizontal axis shows values obtained by dividing the frequency of the electromagnetic wave by the center frequency (i.e., the frequency corresponding to the wavelength λ), and the vertical axis shows reflection coefficients indicating the intensity of the reflected wave. As shown in FIG. 7, the reflection coefficient is −40 dB or less near the center frequency, so that it can be understood that the reflected waves can be significantly reduced.

As described above, according to the configuration of this example embodiment, it is possible to enhance the mechanical strength and the electrical characteristics of a feed circuit of an antenna, particularly an antenna capable of supporting a millimeter wave band. In particular, it is possible to achieve the antenna according to the first example embodiment without adding new processes and increasing costs, because the bridging part can be formed together with the waveguide pattern of the two feed circuit layers included in the feed circuit.

Second Example Embodiment

Figure 8:
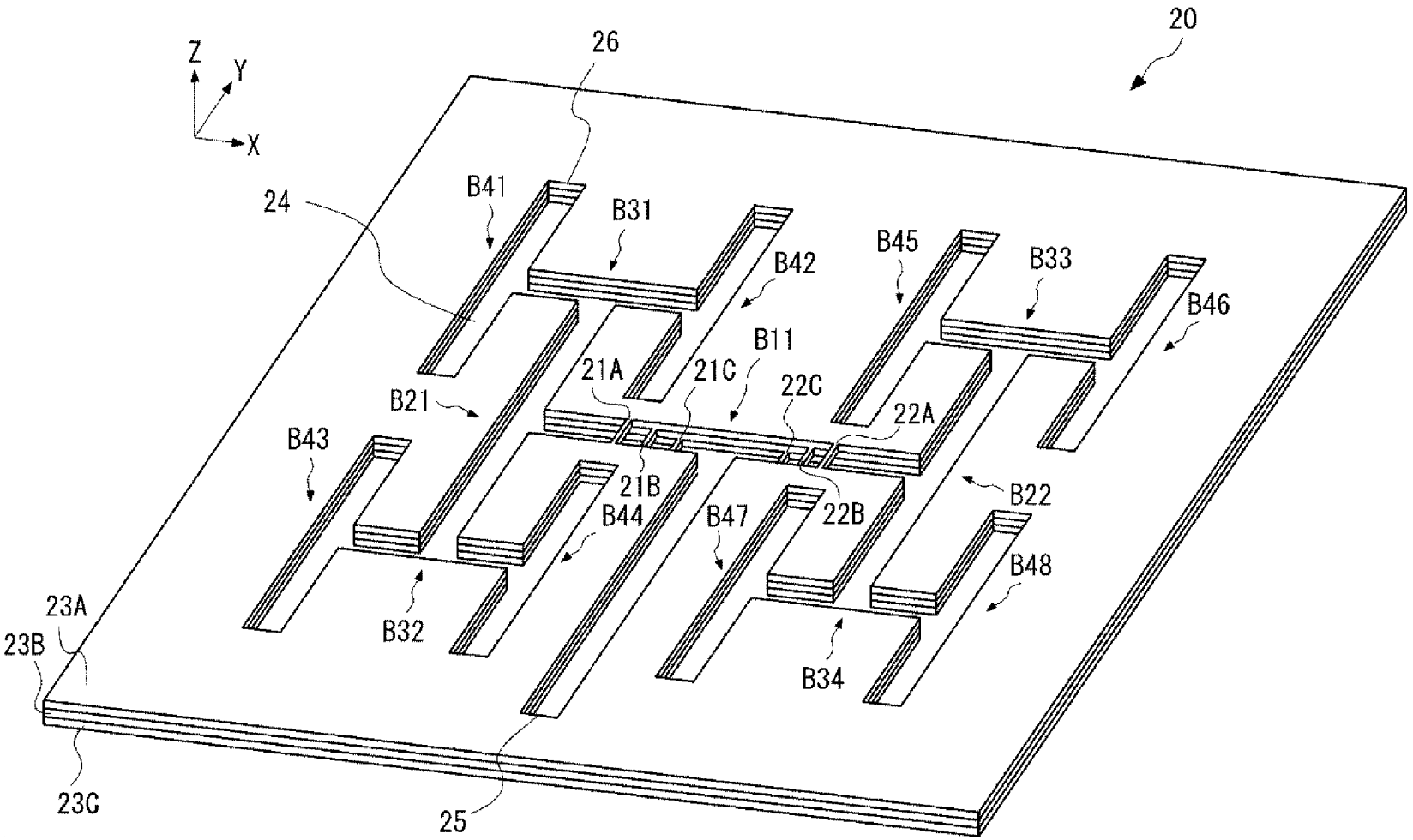
FIG. 8 is a perspective view of a feed circuit of an antenna according to a second example embodiment when viewed from the upper surface side thereof.
Figure 9:
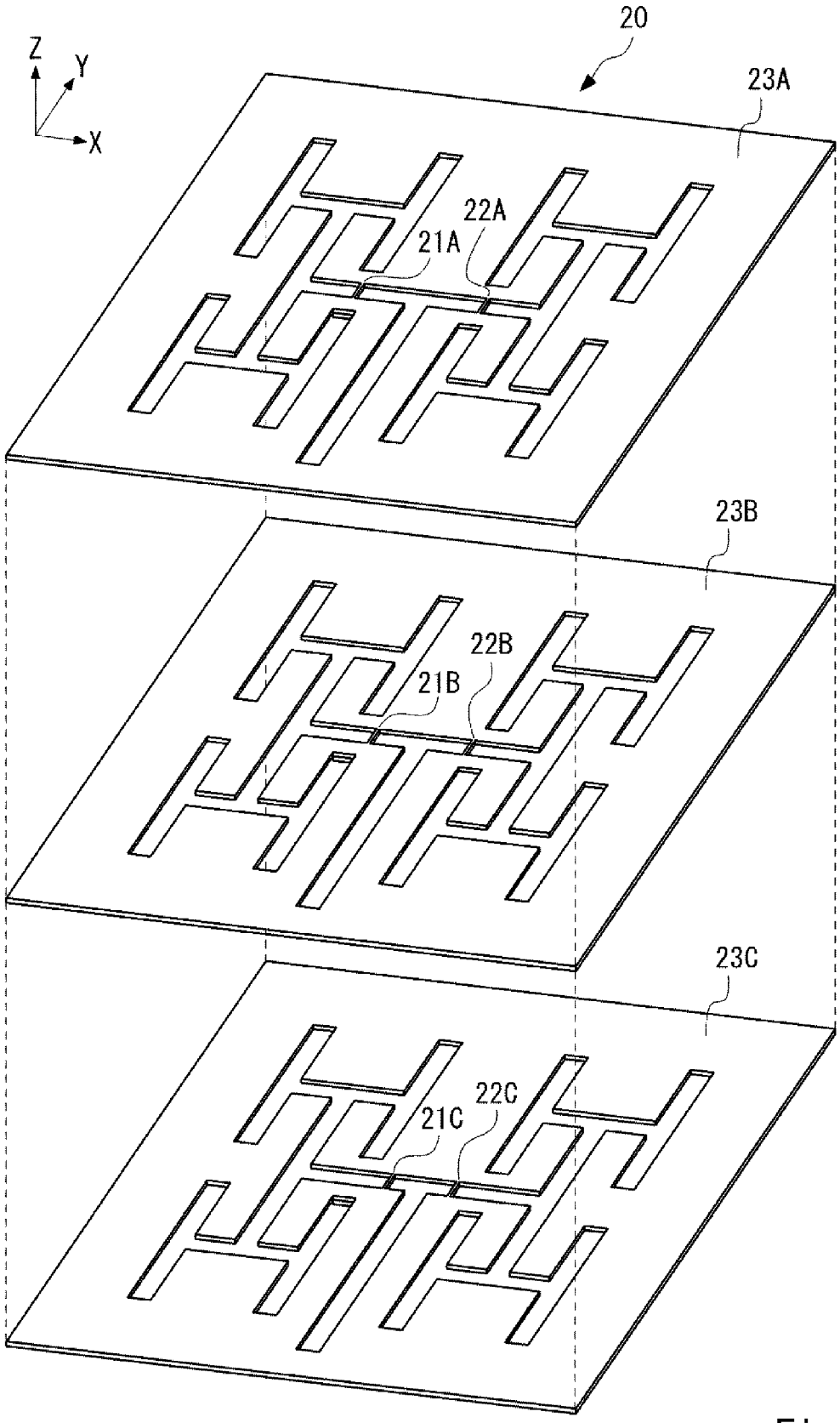
FIG. 9 is an exploded perspective view of the feed circuit of the antenna according to the second example embodiment when viewed from the upper surface side thereof.

An antenna 200 according to a second example embodiment is described. While the bridging part of the antenna 100 is composed of two members, the bridging part of the antenna 200 is composed of three members. FIG. 8 is a perspective view of a feed circuit 20 of the antenna 200 according to the second example embodiment when viewed from the upper surface side thereof. FIG. 9 is an exploded perspective view of the feed circuit 20 of the antenna 200 according to the second example embodiment when viewed from the upper surface side thereof.

The antenna 200 has a configuration in which the feed circuit 10 according to the first example embodiment is replaced with the feed circuit 20. The feed circuit 20 has a configuration in which the bridging parts 11 and 12 of the feed circuit 10 are replaced with bridging parts 21 and 22, respectively. While two feed circuit layers are stacked, thereby constituting the plate-like member 13 of the feed circuit 10, three feed circuit layers are stacked, thereby constituting plate-like member 23 of the feed circuit 20. Specifically, a first feed circuit layer 23A, a second feed circuit layer 23B, and a third feed circuit layer 23C are sequentially stacked, thereby constituting the plate-like member 23. Note that a terminal part 26 corresponds to the terminal part 16.

Figure 10:
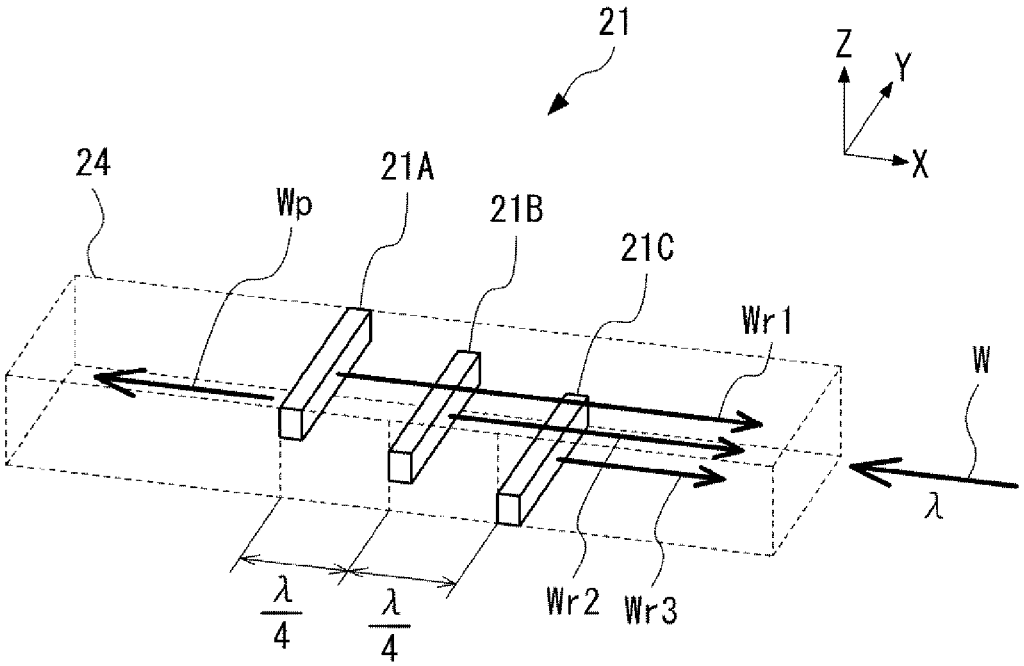
FIG. 10 is an enlarged perspective view of a bridging part according to the second example embodiment.

FIG. 10 is an enlarged perspective view of the bridging part 21 according to the second example embodiment. In FIG. 10, to make understanding of the structure of the bridging part 21 easier, members other than the bridging part 21 are omitted, and a waveguide 24 is indicated by a broken line. The bridging part 21 includes members 21A, 21B, and 21C, each of which extends between the side walls of the waveguide 24. The members 21A, 21B, and 21C are formed on the first feed circuit layer 23A, the second feed circuit layer 23B, and the third feed circuit layer 23C, respectively. That is, the members 21A, 21B and 21C are arranged at different positions in the direction (i.e., the Z direction) perpendicular to the direction in which an electromagnetic wave travels and the longitudinal direction of the members 21A, 21B, and 21C. Note that in a case where the propagation characteristics of electromagnetic waves propagating through the waveguide 14 are taken into consideration, it is desired that the members 21A, 21B, and 21C be arranged so as not to overlap each other when viewed from the direction (X direction) in which the electromagnetic wave travels as in the configuration of this example embodiment. Note that in this example, the positions of the members 21A, 21B, and 21C in the Z direction are changed in this order. However, it is sufficient that the positions of the members 21A, 21B, and 21C be different from one another, and their specific arrangement is not limited to this example.

In the bridging part 21, the members 21A, 21B, and 21C are arranged so as to be separated from one another by a predetermined interval along the direction in which the electromagnetic wave travels, that is, the X direction. It should be noted that as in the first example embodiment, the members 21A, 21B, and 21C are arranged so as to be separated from one another by λ/4.

In the configuration of this embodiment, as in the first example embodiment, it is possible to cancel the reflected waves Wr1 to Wr3 from the members 21A, 21B, and 21C and reduce the number of the reflected waves returning to an introduction end 25, because the members 21A, 21B, and 21C are provided so as to be separated from one another by λ/4 in the direction in which an electromagnetic wave travels.

Next, the bridging part 22 is described. The members 22A, 22B, and 22C of the bridging part 22 correspond to the members 21A, 21B, and 21C of the bridging part 21, respectively. As compared to the members 21A, 21B, and 21C, while the positions of the members 22A, 22B, and 22C are exchanged with one another in the X direction, the configuration of the bridging part 22 is the same as that of the bridging part 21. Accordingly, also in the bridging part 22, it is possible to prevent the reflected waves returning to the introduction end 25 or reduce the number of the reflected waves returning thereto.

As the configuration of the antenna 200 other than the bridging part is the same as that of the antenna 100, the descriptions thereof are omitted.

Figure 11:
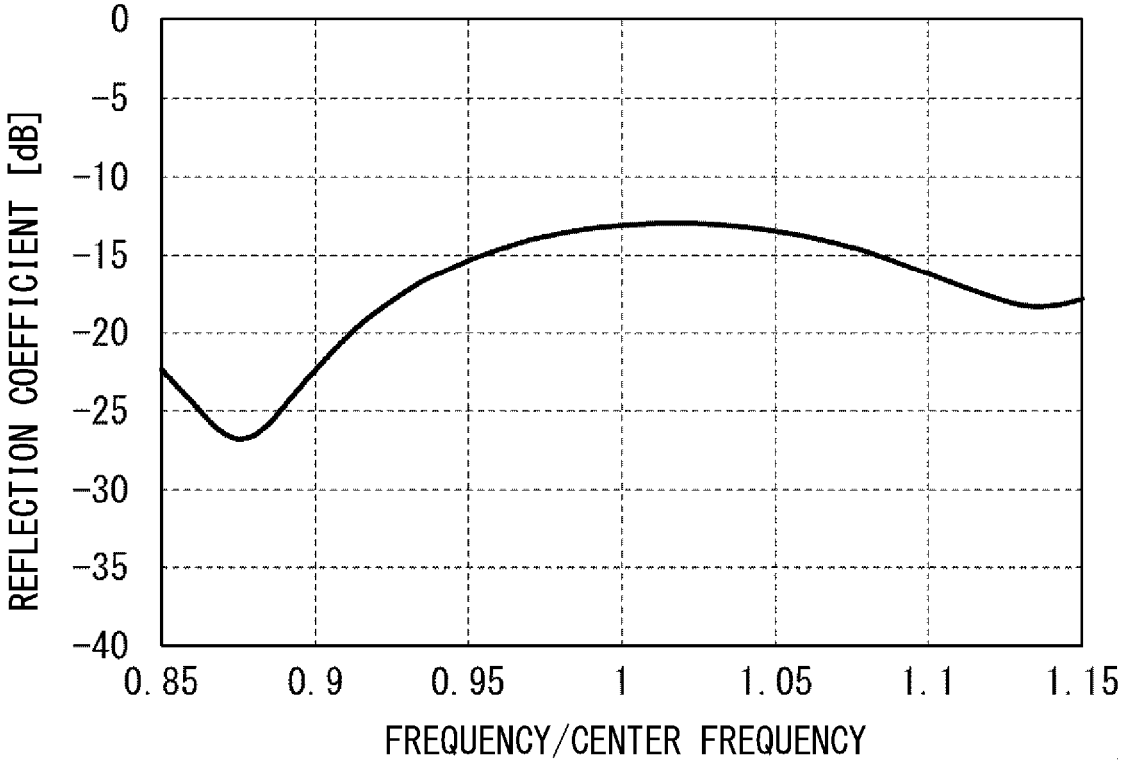
FIG. 11 is a graph showing frequency characteristics of a reflected wave at the introduction end of the feed circuit according to the second example embodiment.

FIG. 11 is a graph showing the frequency characteristics of the reflected waves that reach the introduction end 25 of the feed circuit 20 according to the second example embodiment. In FIG. 11, the horizontal axis shows values obtained by dividing the frequency of the electromagnetic wave by the center frequency (i.e., the frequency corresponding to the wavelength λ), and the vertical axis shows reflection coefficients indicating the intensity of the reflected wave. As shown in FIG. 11, the reflection coefficient is approximately −13 dB or less near the center frequency, so that it can be understood that the reflected waves can be significantly reduced.

Further, in the configuration of this example embodiment, the frequency dependence of the reflection coefficient is smaller than that in the first example embodiment. As a result, according to the configuration of this example embodiment, it is possible not only to reduce reflection loss but also to widen the band in which reflection can be reduced. Accordingly, when transmission and reception of electromagnetic waves of a plurality of frequencies are performed by a single antenna, the antenna according to this example embodiment can be employed.

As described above, according to the configuration of this example embodiment, it is possible to enhance the mechanical strength and the transmission characteristics of a feed circuit of an antenna, particularly an antenna capable of supporting a millimeter wave band. Further, it is possible to support transmission and reception of broadband electromagnetic waves by a single antenna. In particular, it is possible to achieve the antenna according to the second example embodiment without adding new processes and increasing costs, because the bridging part can be formed together with the waveguide pattern of the three feed circuit layers included in the feed circuit.

Note that in this example embodiment, although the bridging part has been described as a component composed of three members, it is merely an example. It is obvious that the bridging part may be formed of four or more members as long as the reduction of the number of and the band of the reflected waves fall within a desired range.

Third Example Embodiment

Figure 12:
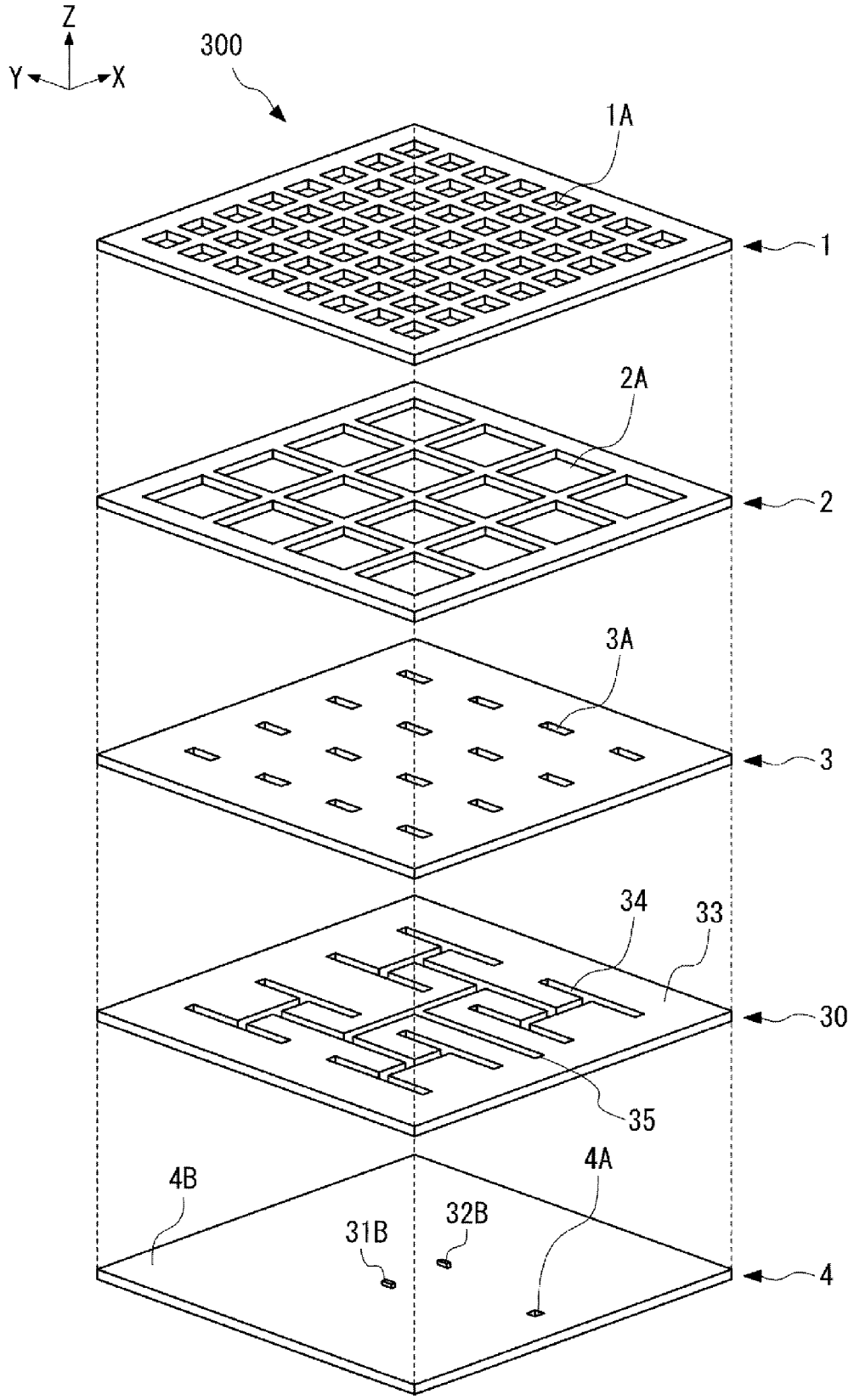
FIG. 12 is an exploded perspective view of the antenna according to the third example embodiment when viewed from the upper surface side thereof.
Figure 13:
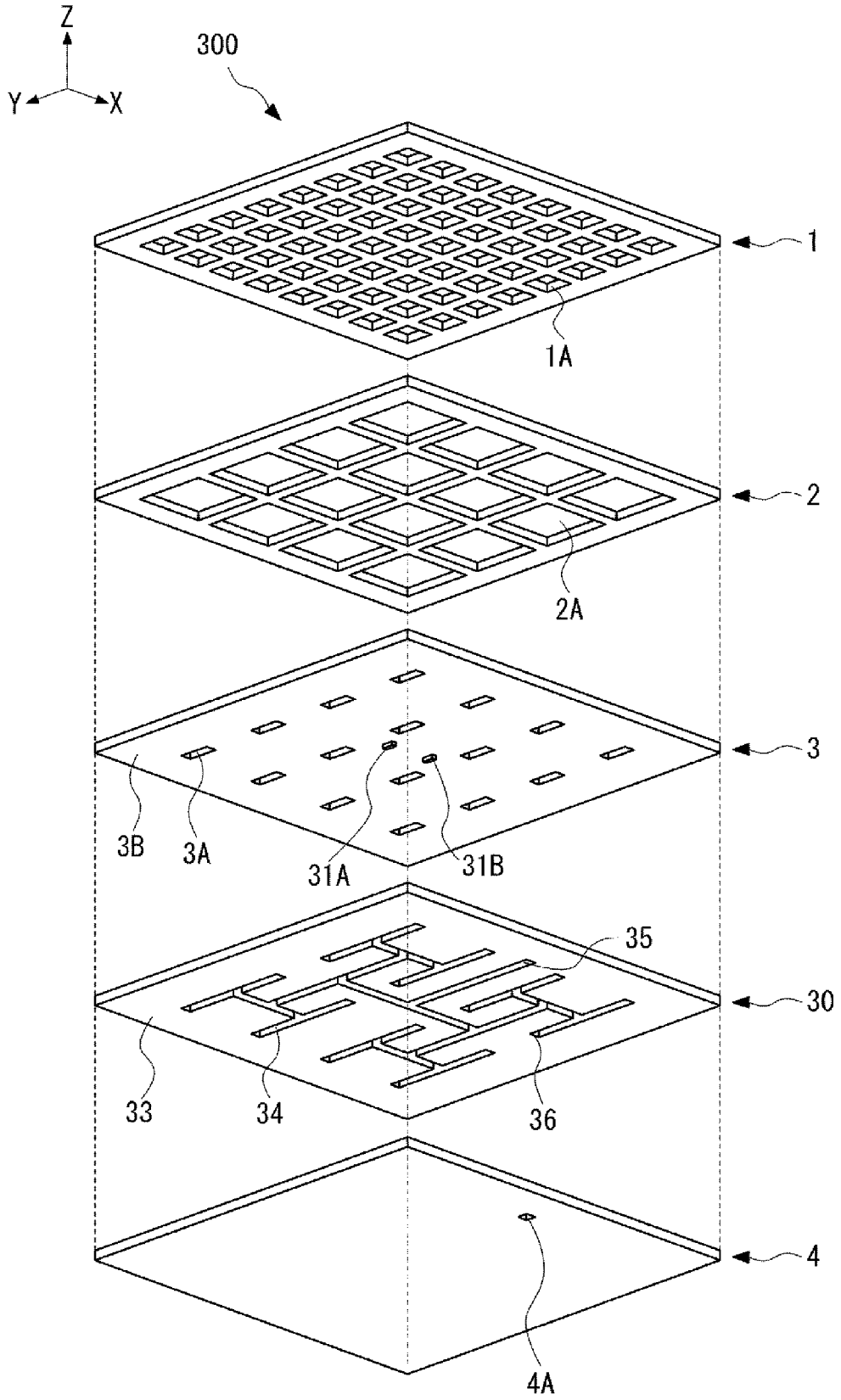
FIG. 13 is a perspective view of the antenna according to the third example embodiment when viewed from the bottom surface side thereof.

An antenna 300 according to a third example embodiment is described. In the antennas according to the first and second example embodiments, the bridging part is formed integrally with the feed circuit layer. However, in the antenna 300, members of the bridging part are formed in two layers that sandwich the feed circuit therebetween. FIG. 12 is an exploded perspective view of the antenna 300 according to the third example embodiment when viewed from the upper surface side thereof. FIG. 13 is a perspective view of the antenna 300 according to the third example embodiment when viewed from the bottom surface side thereof.

The antenna 300 has a configuration in which the feed circuit 10 according to the first example embodiment is replaced with a feed circuit 30. The feed circuit 30 is configured as a feed circuit including no bridging part. In this example embodiment, projected members 31A and 32A provided on a bottom surface 3B of the coupling layer 3 and projected members 31B and 32B provided on an upper surface 4B of the bottom plate 4 constitute the bridging part as a member extending between the side walls of a waveguide 34. Note that a terminal part 36 corresponds to the terminal part 16.

Figure 14:
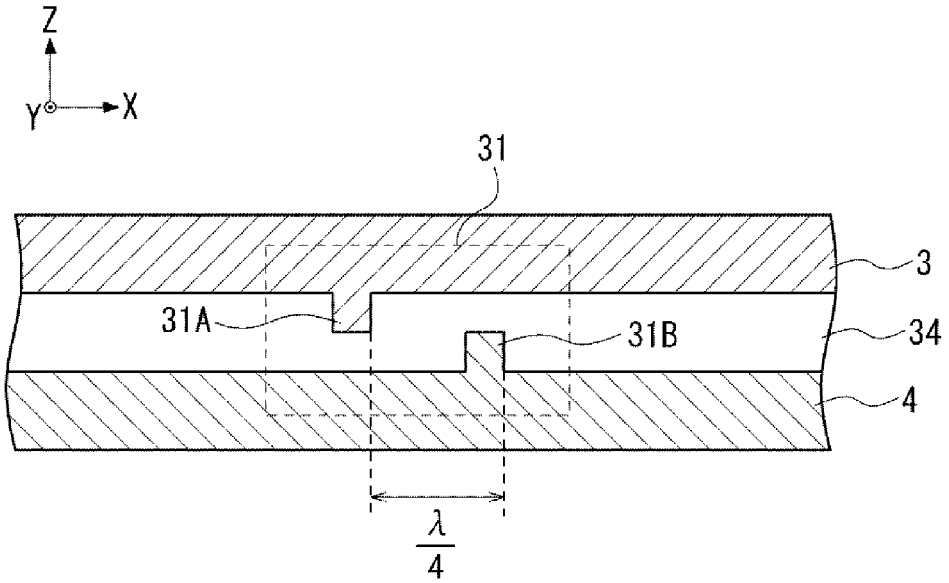
FIG. 14 is an enlarged front view showing a configuration of a bridging part according to the third example embodiment.
Figure 15:
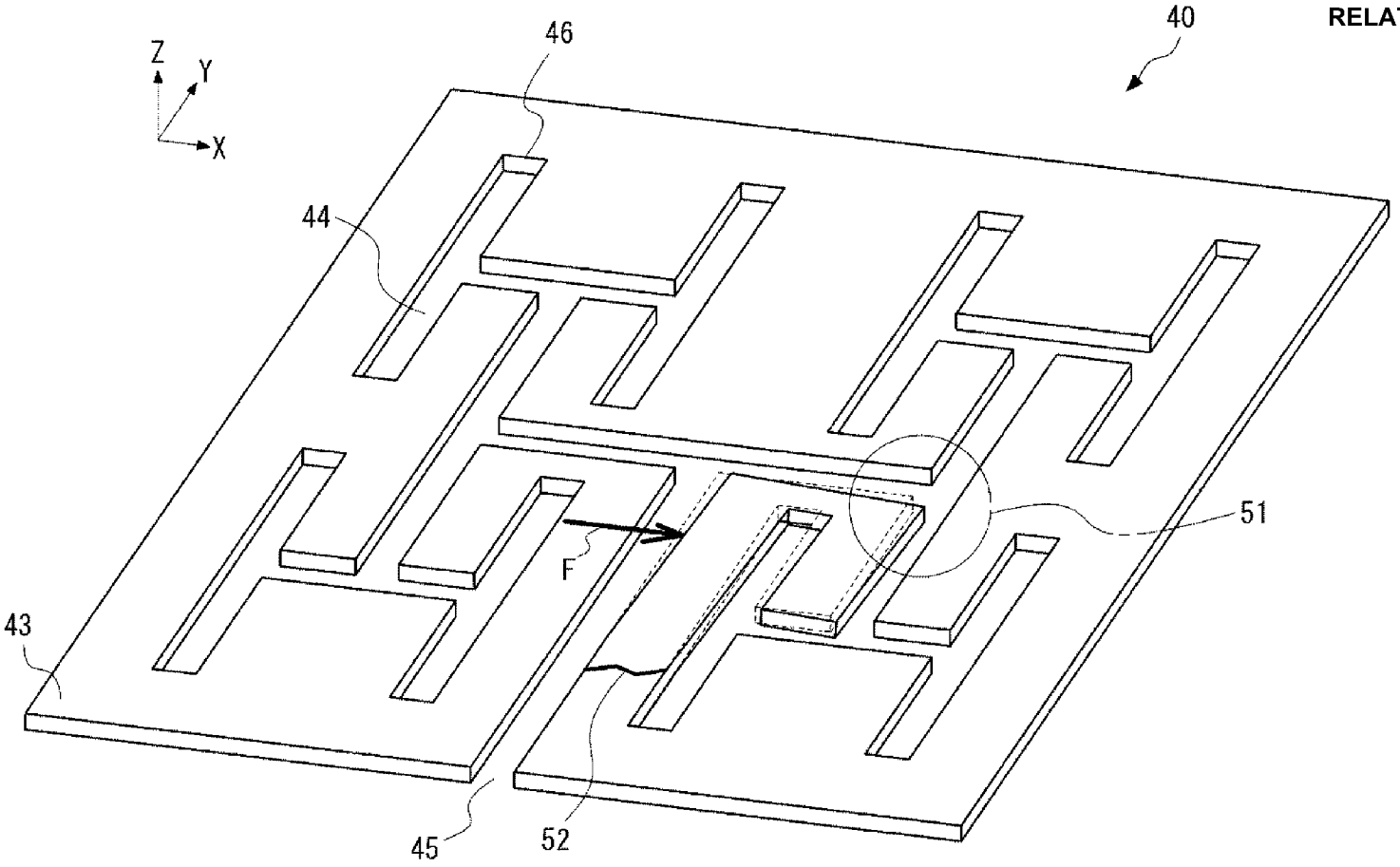
Fig. 15 RELATED ART
FIG. 15 is a perspective view showing a configuration of a common feed circuit.

FIG. 14 is an enlarged front view showing a configuration of a bridging part 31 of the antenna 300 according to the third example embodiment. In FIG. 14, to make understanding of the structure of the bridging part 31 easier, members other than the bridging part 31 are omitted, and the waveguide 34 is indicated by a broken line. As shown in FIG. 14, when the coupling layer 3, the feed circuit 30, and the bottom plate 4 are stacked, the bridging part 31 is formed by the members 31A and 31B fitting into the waveguide 34 while a bridging part 32 is formed by the members 31B and 32B fitting into the waveguide 34. That is, it can be understood that the bridging part 31 includes the members 31A and 31B that are located between the two side surfaces of the waveguide 34 and extend in the Y direction, as in the case of the bridging part 11 of the antenna 100. Note that as a matter of course, it is desired that the length of each of the members 31A and 31B in the Y direction be equal to the design value of the width of the waveguide 34 in the Y direction. In this case, both ends of each of the members 31A and 31B are bonded to the respective opposing side surfaces of the waveguide 34 without a gap therebetween. By this configuration, it is possible to prevent the width of the waveguide 34 from being narrower than the design value due to a deformation of the feed circuit 30.

Next, the bridging part 32 is described. Members 32A and 32B of the bridging part 32 correspond to the members 31A and 31B of the bridging part 31 respectively. As compared to the members 31A and 31B, while the positions of the members 32A and 32B are changed with each other in the X direction, the configuration of the bridging part 32 is the same as that of the bridging part 31. Accordingly, as in the case of the bridging part 31, in the bridging part 32 also, it is possible to prevent the reflected waves returning to an introduction end 35 or reduce the number of the reflected waves returning thereto.

Other Example Embodiments

The present invention is not limited to the above-described embodiments, and can be appropriately changed without departing from the spirit of the invention. The feed circuit is composed of two feed circuit layers in the first example embodiment, and the feed circuit is composed of three feed circuit layers in the second example embodiment, however they are merely examples. For example, the feed circuit may be formed using a single layer or a plate-like member if the members of the bridging part can be formed by repeating production and etching of an etching mask a plurality of times or using a 3D printer or the like.

In the above-described example embodiments, although the members of the bridging part has a quadrangular-prism shape, it is merely an example. For example, the cross section of the member of the bridging part in the X-Z plane is not limited to a square, but may be a rounded shape, a barrel shape, or a pincushion shape, and various shapes may be used as appropriate.

Further, the position of the bridging part and the number of bridging parts are not limited to those in the above-described examples, and any number of bridging parts can be provided at any position as long as the electrical characteristics of the antenna fall within an allowable range. Note that in order to achieve the symmetry of phases, it is desired that a pair of bridging parts be provided at a position symmetrical with respect to each branch.

Although the present invention is described above with reference to the example embodiments, the present invention is not limited to the above-described example embodiments. Various modifications that can be understood by those skilled in the art can be made to the configuration and details of the present invention within the scope of the invention.

REFERENCE SIGNS LIST

1 RADIATION SLOT LAYER
1A RADIATION SLOT
2 CAVITY LAYER
2A CAVITY
3 COUPLING LAYER
3A COUPLING SLOT
4 BOTTOM PLATE
4A FEED SLOT
10, 20, 30 FEED CIRCUIT

11, 12, 21, 22, 31, 32 BRIDGING PART
11A, 11B, 21A, 21B, 31A, 31B MEMBER
13, 23, 33 PLATE-LIKE MEMBER
13A, 13B, 23A, 23B, 23C FEED CIRCUIT LAYER
14, 24, 34, 44 WAVEGUIDE
15, 25, 35, 45 INTRODUCTION END
16, 26, 36, 46 TERMINAL PART
100, 200, 300 ANTENNA
B11, B21, B22, B31-B34, B41-B48 BRANCH

The invention claimed is:

1. An antenna comprising:

a bottom plate provided with a feed slot;

a feed circuit comprising: a waveguide having a plurality of branches that is coupled to the feed slot at one place, the waveguide having two side surfaces facing in a direction perpendicular to a direction in which the waveguide guides an electromagnetic wave; and a bridging part that is located between the two side surfaces of the waveguide and extends in a direction intersecting the direction in which the waveguide guides the electromagnetic wave, the bridging part comprising a plurality of members provided at predetermined intervals in the direction in which the waveguide guides the electromagnetic wave to cause an intensity of a reflected wave to change;

a coupling layer provided with a plurality of coupling slots that are coupled to a plurality of ends of the waveguide;

a cavity layer provided with a plurality of cavities that are coupled to the plurality of coupling slots; and a radiation slot layer provided with a plurality of radiation slots that are coupled to the plurality of cavities and are each configured to radiate an electromagnetic wave, wherein each of the predetermined intervals is an odd multiple of ¼ of a wavelength included in a band of the electromagnetic wave to be guided by the waveguide.

2. A feed circuit comprising:

a waveguide having a plurality of branches, the waveguide being provided on a plate-like member, the waveguide having two side surfaces facing in a direction perpendicular to a direction in which the waveguide guides an electromagnetic wave; and a bridging part that is located between the two side surfaces of the waveguide and extends in a direction intersecting the direction in which the waveguide guides the electromagnetic wave, the bridging part comprising a plurality of members provided at predetermined intervals in the direction in which the waveguide guides the electromagnetic wave to cause an intensity of a reflected wave to change, wherein each of the predetermined intervals is an odd multiple of ¼ of a wavelength included in a band of the electromagnetic wave to be guided by the waveguide.

3. The feed circuit according to claim 2, wherein the plurality of members are provided at positions where they do not overlap each other in the direction in which the waveguide guides the electromagnetic waves.

4. The feed circuit according to claim 2, wherein a plurality of the bridging parts are provided in the waveguide.

5. The feed circuit according to claim 4, wherein the plurality of bridging parts are arranged at positions symmetrical with respect to the plurality of branches of the waveguide.

6. The feed circuit according to claim 5, wherein the plurality of bridging parts are arranged at positions symmetrical with respect to a first branch of the plurality of branches when viewed from an introduction end of the waveguide.

7. The feed circuit according to claim 2, wherein the plate-like member is composed of a plurality of layers, and the plurality of members are formed in the respective plurality of layers.

8. An antenna comprising:

the feed circuit according to claim 2;

a bottom plate provided with a feed slot configured to feed electric power to the feed circuit;

a coupling layer provided with a plurality of coupling slots that are coupled to a plurality of ends of the waveguide, wherein a first member included in the plurality of members is provided as a member projected on a surface of the bottom plate on the feed circuit side, a second member included in the plurality of members is provided as a member projected on a surface of the coupling layer on the feed circuit side, and the first and the second members are fitted into the waveguide when the feed circuit, the bottom plate, and the coupling layer are stacked.

9. A method for configuring a feed circuit, comprising forming a bridging part to be located between two side surfaces of a waveguide, wherein, the waveguide has a plurality of branches and is provided on a plate-like member, the two side surfaces face in a direction perpendicular to a direction in which the waveguide guides an electromagnetic wave, the bridging part extends in a direction intersecting the direction in which the waveguide guides the electromagnetic wave, the bridging part comprises a plurality of members provided at predetermined intervals in the direction in which the waveguide guides the electromagnetic wave to cause an intensity of a reflected wave to change, and each of the predetermined intervals is an odd multiple of ¼ of a wavelength included in a band of the electromagnetic wave to be guided by the waveguide.

* * * * *